US005833274A

United States Patent [19]

Schmidt

[11] Patent Number: 5,833,274

[45] Date of Patent: Nov. 10, 1998

[54] METHOD OF PRODUCING A PRE-PRINTED LABEL AND THE LABEL

[75] Inventor: Martin Schmidt, Freeland, Wash.

[73] Assignee: Interstate Label Company, Freeland, Wash.

[21] Appl. No.: 612,807

[22] Filed: Mar. 11, 1996

[51] Int. Cl.[6] ..... B42D 15/00

[52] U.S. Cl. ..... 283/67; 283/81

[58] Field of Search ..... 101/3.1, 4, 5, 6, 101/22, 23, 24; 283/81, 79, 80, 101, 70, 67, 104, 105, 117

[56] References Cited

U.S. PATENT DOCUMENTS

| | | | |
|---|---|---|---|
| 56,679 | 7/1866 | Tapley et al. | 101/5 |
| 3,859,157 | 1/1975 | Morgan | 156/268 |
| 3,900,645 | 8/1975 | Morgan | 428/41 |

OTHER PUBLICATIONS

Jacobs Gardner Office Supply Catalogs, p. 444, item B., Dec. 1990.

"Group 3200 Cycle Time Meeting" Sheet of die cut labels., Jul. 1997.

*Primary Examiner*—Willmon Fridie, Jr.

*Attorney, Agent, or Firm*—Jensen & Punitgam, P.S.

[57] ABSTRACT

The method of preparing individual label stock, comprising the provision of a roll of pre-sized label stock having a face layer, a layer of adhesive and a backing layer, and feeding said stock to a printer pre-supplied with printing plates and cutting dies such that the label stock is simultaneously printed, cut to individual label stock size, and the face sheet is cut to define the label and the resultant individual label stock.

1 Claim, 2 Drawing Sheets

METHOD OF PRODUCING A PRE-PRINTED LABEL AND THE LABEL

TECHNICAL FIELD

This invention relates to pre-printed labels, utilizing the sender's or user's art, which are designed for use with a computer-driven printer and the method of producing same. The labels are pre-printed and cut from a base stock having a standard envelope size, and the pre-cut removable label portion is located within the base stock such that a standard word processing computer program will print the recipient's address on a label which has been pre-printed and die-cut, such that the recipient's address is properly positioned on the label by the computer program and this label is then removed and placed on a larger container.

BACKGROUND OF THE INVENTION

Pre-glued labels having removable protective paper are known but such labels were designed primarily for use in a typewriter. Pre-cut and pre-glued labels on backing for use with a laser printer are known. However, to the best of the inventor's knowledge, the use of a press to pre-cut and pre-print with a customized imprint simultaneously upon a smaller-size laminate stock sheet, wherein the smaller label is readily removed, is not currently known.

References known to the inventor include U.S. Pat. No. 3,859,157 granted to Morgan, Jan. 7, 1975, which teaches the method of making a scored paper laminate; and U.S. Pat. No. 3,900,645 granted to Morgan, Aug. 19, 1975, teaches the broad concept of a flexible laminate for use as a label, wherein the backing paper has a tear line of compacted thickness.

DISCLOSURE OF THE INVENTION

With the above-noted prior art in mind, it is an object of the present invention to provide an inexpensive, handy, single-use label stock for packages or the like, wherein the individual label stock is in the form of a three-layer laminate, including the face sheet which has a pre-printed return label located within a pre-cut area (through the face sheet). Upon the opposite side of the pre-printed return address face sheet is a layer of adhesive covered by a backing sheet.

Accordingly, it is a further object of the present invention to provide pre-printed label stock in individual units for use with a computer-driven sheet fed printing device wherein the three-layer laminate is fed through a press wherein it is simultaneously printed with the desired material and the face sheet is cut, defining the label and the label stock cut to a predetermined size prior to packaging and shipping.

Another object of the present invention is to produce a pre-printed label comprising the steps of preparing the necessary artwork, producing a film including the necessary distortion, reproducing the film on at least one plastic plate, mounting at least one plate to a rotary cylinder installed in a flexographic rotary web press, mounting the cutting dies, including one to sever the laminated label base material and one to cut through the surface layer defining the label, simultaneously printing and cutting the label, and stacking and packaging the complete label stock elements.

BEST MODE FOR CARRYING OUT THE INVENTION

Figure 1:
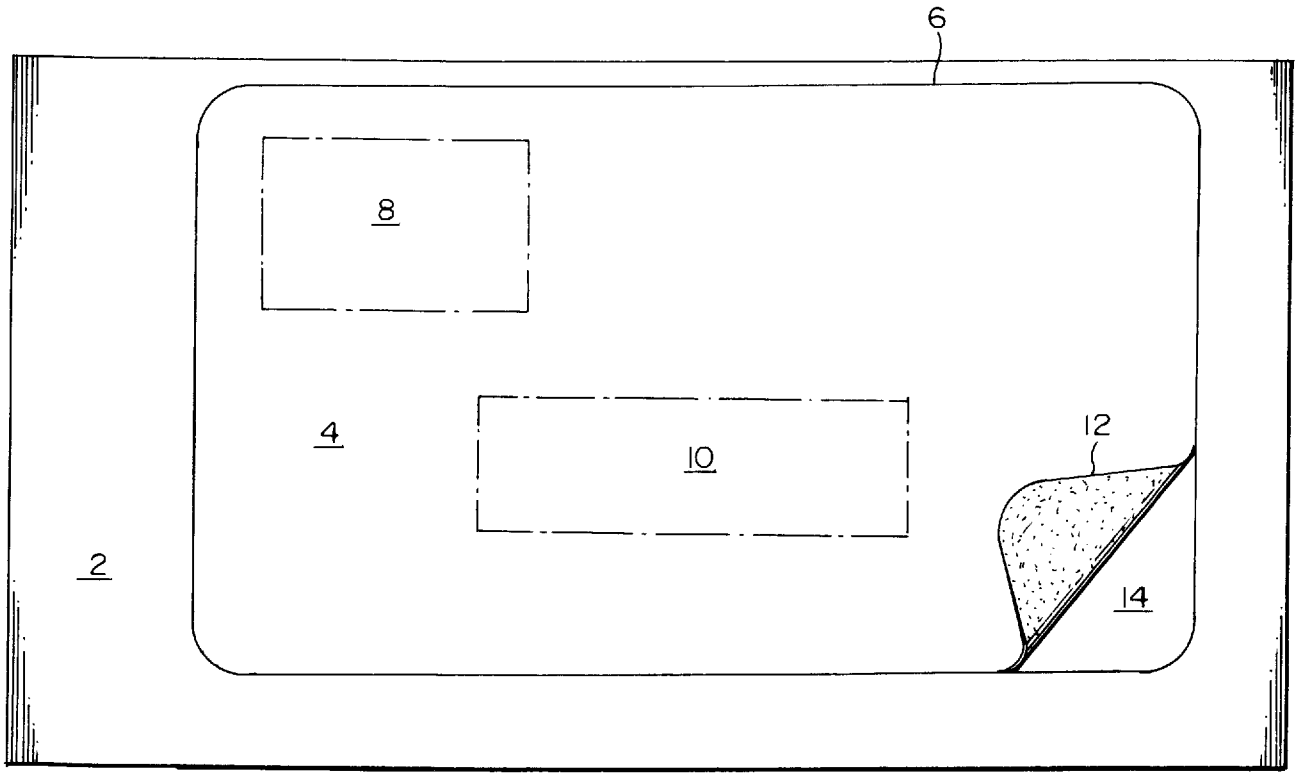
FIG. 1 is a plan view of the inventive label.
Figure 2:
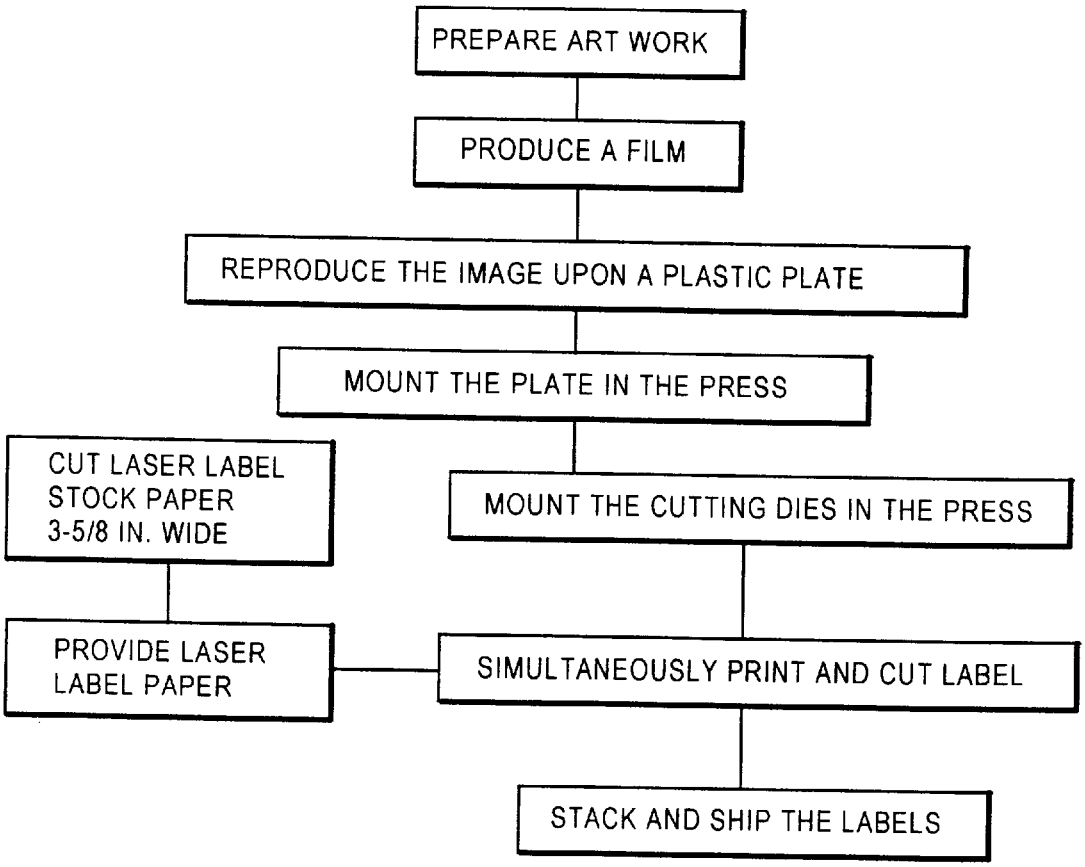
FIG. 2 is a block diagram disclosing the method of producing the inventive label.

As seen in FIG. 1, the inventive label stock as supplied to the user is shown. As seen in this view, the stock comprises a top or face sheet 2 of 6½ inches by 3⅝ inches that includes an internal, pre-scored label portion 4 defined by cut lines 6, which extend through the face sheet only, wherein the interior dimension is 3 inches by 5 inches, and this comprises the label to which a predetermined logo or address will be preprinted as at 8. There will be a space as at 10 for an address to be imprinted by the user using a standard word processing computer program when in the envelope print mode. To accommodate the program, there will be a border of ⅛ inch along the top side, ½ inch along the bottom side, 1 inch on the left end, and ½ inch at the right end. Further to be seen in this view is the pre-applied adhesive 12 and the protective backing 14.

Once the addressee's address has been placed in 10, the user will lift a corner (as shown in this view), removing the label and placing the same upon a package or large envelope. Since the pre-printed label will have the same appearance as the user's stationery or logo, it will present a uniform, business-like image.

The method of producing the desired label includes the following steps:

The customer's art is produced using standard computer graphics and a film is then produced by an image setter and film processor. The film has the appropriate distortion for flexographic rotary web printing. The film is reproduced on a plastic flexographic printing plate by a UV exposure process, and the plate is then sent to the press. At the press, the plate (or plates for multicolor labels) is positioned and mounted on rotary cylinders and installed in the press. Liquid flexographic inks are available at the press. Rotary steel cutting dies to cut out the interior 3 by 5 inches label shapes through the face sheet only and to separate the individual 3⅝ by 6½ inches shapes from each other are installed on the press. It is to be understood that the steel cutting tool that cuts the interior 3 by 5 inches label shape is a fixed knife from a solid piece of steel which appears like a cookie cutter used in baking. These dies could also be made from a flat, flexible piece of steel and then wrapped and fastened around a steel cylinder. This way, the same steel cylinder can receive a variety of flat, flexible dies. The steel die used to sever the 6½ inches overall label length is also a rotary steel cutting die which may be made from either a single piece of steel or be fitted with removable cutting blades. The 3 by 5 inches die at the printing plate is positioned over the 3⅝ by 6½ inches overall shape. A large paper roll of pressure-sensitive paper is placed on the press, and the press is started, putting ink to paper, die-cutting the shapes and separating each shape from each other. It is to be understood that the paper can be acquired in pre-slit condition at 3⅝ inches wide and in lengths of 1800–2400 feet, or otherwise the user could slit and rewind from wider stock.

Thus, it can be seen that the present invention contemplates providing a single-use label for large envelopes or packages wherein the standard word processing program is used to imprint the label with the addressee's address; and since the label has been pre-printed with the addressor's address and pre-scored, the user then simply removes the label within the scored area and applies it directly to the package. Use of the present invention assures that the user's business image is consistent and attractive.

I claim:

1. A method of producing a preprinted label from a multilayered material, comprising a backing sheet, an adhesive layer and an upper surface layer, for use in a laser printer, addressed using a word processing program, comprising the steps of:

a. preparing the artwork which will appear on the label;

b. producing a film including the artwork, wherein the film includes the distortion necessary to accommodate a rotary printing device;

c. reproducing the film on at least one plastic plate;

d. mounting the said one plastic plate on at least one rotary cylinder installed in a press;

e. mounting cutting dies to the cylinder, one to sever the backing sheet into predetermined sized units and one to cut through the surface layer of the multilayered material defining the actual label;

f. simultaneously printing and cutting the labels; and g. stacking and packaging the completed labels.

* * * * *